US011161006B2

(12) United States Patent
Dean

(10) Patent No.: US 11,161,006 B2
(45) Date of Patent: Nov. 2, 2021

(54) TANDEM SIT-UP DEVICE

(71) Applicant: Justin Ray Dean, Sacramento, CA (US)

(72) Inventor: Justin Ray Dean, Sacramento, CA (US)

( * ) Notice: Subject to any disclaimer, the term of this patent is extended or adjusted under 35 U.S.C. 154(b) by 19 days.

(21) Appl. No.: 16/811,643

(22) Filed: Mar. 6, 2020

(65) Prior Publication Data

US 2021/0275855 A1 Sep. 9, 2021

(51) Int. Cl.

*A63B 21/28* (2006.01)
*A63B 23/02* (2006.01)
*A63B 21/00* (2006.01)

(52) U.S. Cl.

CPC ..... *A63B 21/28* (2013.01); *A63B 21/4015* (2015.10); *A63B 23/0211* (2013.01); *A63B 2210/50* (2013.01); *A63B 2225/09* (2013.01)

(58) Field of Classification Search

CPC . A63B 23/0211; A63B 23/0205; A63B 23/02; A63B 23/0238; A63B 23/0227; A63B 21/28; A63B 21/285; A63B 21/00054; A63B 21/000185; A63B 21/068; A63B 21/1457; A63B 21/1465

See application file for complete search history.

(56) References Cited

U.S. PATENT DOCUMENTS 3,287,016 A * 11/1966 Mayer ..... A63B 23/0211 482/140
3,734,493 A 5/1973 Hasekian
4,230,313 A 10/1980 Chupp, Jr.
4,284,274 A 8/1981 Boothe
4,508,335 A * 4/1985 Kelley ..... A63B 23/0211 482/140
4,809,971 A 3/1989 Goldish
4,850,589 A 7/1989 Block
5,209,711 A * 5/1993 Scrima ..... A61H 1/0244 482/51
5,722,923 A 3/1998 Lui
6,428,450 B1 8/2002 Ho et al.
6,447,434 B1 9/2002 Waters
7,207,932 B1 4/2007 Dean
7,232,405 B2 6/2007 Ko
9,302,149 B1 * 4/2016 Parker ..... A63B 23/0211
9,750,968 B2 * 9/2017 Heimann ..... A63B 21/4029
2003/0199372 A1 * 10/2003 Robinson ..... A63B 23/0222 482/140
2007/0155602 A1 * 7/2007 Huis ..... A63B 21/28 482/140
2010/0056350 A1 3/2010 Slattery

* cited by examiner

*Primary Examiner* — Nyca T Nguyen
*Assistant Examiner* — Andrew M Kobylarz
(74) *Attorney, Agent, or Firm* — Dunlap Bennett & Ludwig, PLLC

(57) ABSTRACT

A tandem sit-up device is provided. The tandem sit-up device has two support frameworks pivotably interconnected by a pivot bar so that the device moves between a flat, operable condition and a folded, storage condition. A distal end of the support framework may provide a seat portion. The pivot bar may provide an inner disc and outer disc rotatable relative to each other for moving between the operable and storage conditions. Each disc type provides a pair of arms for a proximal end of each support framework to selectively attach to so that a distance between the associated seat portion and a foot strap supported by the pair of arms.

5 Claims, 4 Drawing Sheets

TANDEM SIT-UP DEVICE

BACKGROUND OF THE INVENTION

The present invention relates to exercise equipment and, more particularly, to a tandem sit-up device.

Getting regular exercise is important for maintaining a healthy lifestyle, today more than ever as people's lives become increasingly sedentary in both work and leisure in today's one-click culture. Sit-ups are a classic exercise that delivers a vigorous workout for an individual's core muscles; however, sit ups have traditionally been a solo activity. And as many can attest to, doing exercises by oneself can be boring, and only increases the likelihood that an individual will shy away from and/or completely quit an otherwise great exercise (which explains while there are so many group exercises, such as cycling class).

Currently, tandem sit-ups are performed by two people (uncomfortably) interlocking their feet. There is, unfortunately, no device or apparatus facilitates connecting two users to do tandem sit-ups.

As can be seen, there is a need for a tandem sit-up device, facilitating two people to engage in tandem sit-ups, so that it is not only easier but more social, and thus more likely to encourage users to maintain their weekly regime of sit-ups. The present invention allows the two users to leverage each other without having to interlock their feet which ultimately leads to an easier, more comfortable tandem sit-up experience.

SUMMARY OF THE INVENTION

In one aspect of the present invention, a tandem sit-up device includes the following: two support frameworks interconnected by a pivot assembly so that the two support frameworks move between an operable condition and a folded storage condition; each support framework extends between a distal end and a proximal end operatively associating with the pivot assembly; a seat portion connected to each distal end; and a foot strap provided adjacent to each proximal end, whereby a human user seated on the seat portion engages their feet with the foot strap adjacent thereto to do a sit-up.

In another aspect of the present invention, the above-mentioned tandem sit-up device includes the pivot assembly having: a pivot bar; an inner disc rotatably connected to an outer disc on each end of the pivot bar; the proximal end operatively associated with each inner disc and each outer disc; an inner pin cavity provided by each inner disc; an outer pin cavity provided by each outer disc; a spring in each inner cavity; a locking pin that engages the spring and extends into the outer pin cavity in a locked engagement between the outer and inner discs; and an unlocking button operatively associated with each locking pin for urging the locking pin against the spring and out of the outer pin cavity in an unlocked engagement, enabling the outer and inner discs to rotate relative to each other, wherein each support framework comprises two spaced apart frame elements; each arm telescopically engages one of the two spaced apart frame elements; and a snap button provided by at least one of the two spaced apart frame elements for selectively engaging one of a plurality of adjustment holes provided along a length of at least two of the arms.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a tandem sit-up device having two support frameworks pivotably interconnected by a pivot bar so that the device moves between a flat, operable condition and a folded, storage condition. A distal end of the support framework may provide a seat portion. The pivot bar may provide an inner disc and outer disc rotatable relative to each other for moving between the operable and storage conditions. Each disc type provides a pair of arms for a proximal end of each support framework to selectively attach to so that a distance between the associated seat portion and a foot strap supported by the pair of arms.

Figure 1:
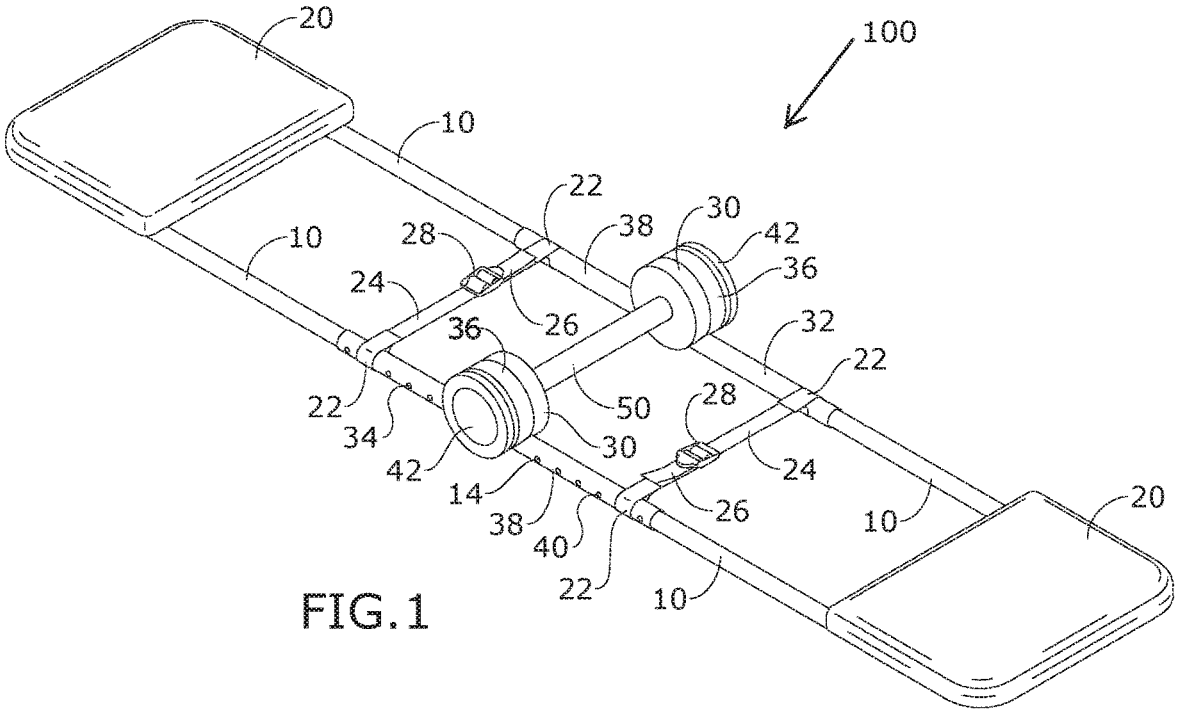
FIG. 1 is a perspective view of an exemplary embodiment of the present invention.
Figure 2:
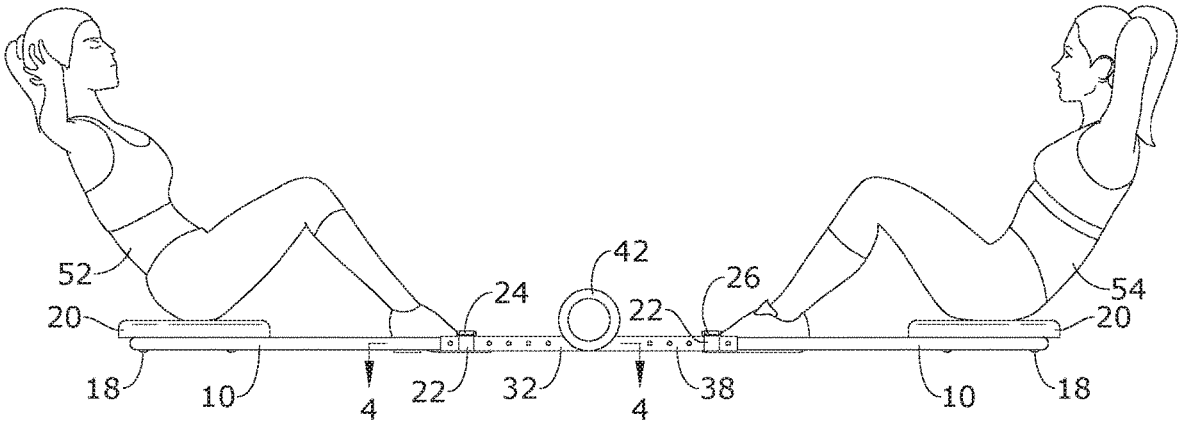
FIG. 2 is a front view of an exemplary embodiment of the present invention, shown in use.
Figure 3:
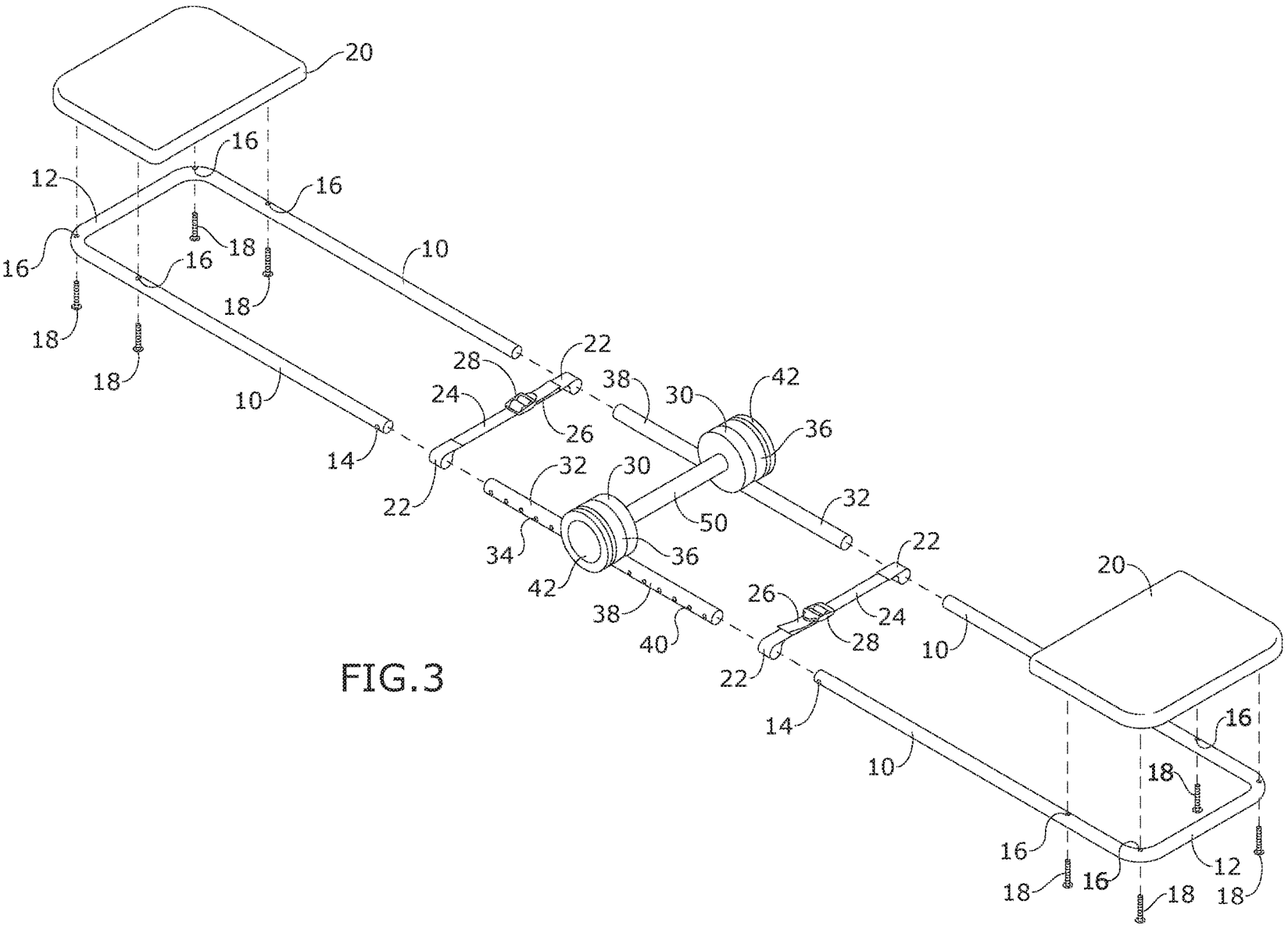
FIG. 3 is an exploded perspective view of an exemplary embodiment of the present invention.
Figure 4:
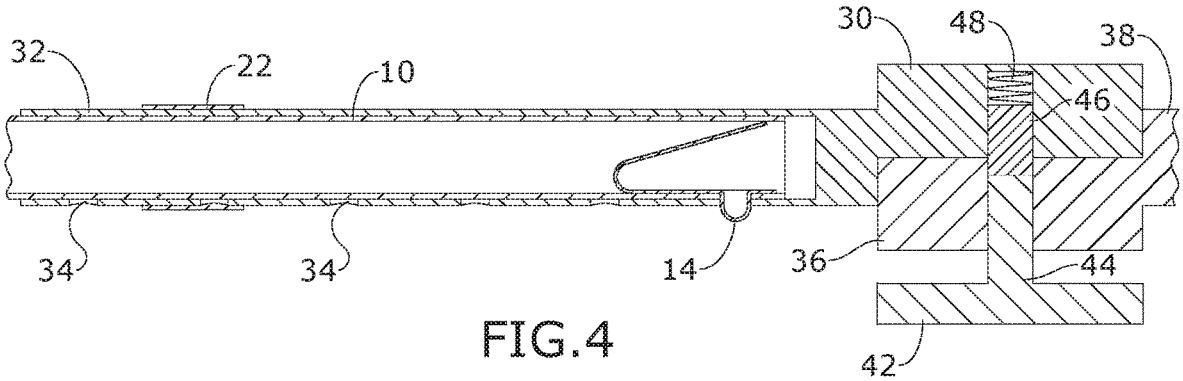
FIG. 4 is a section view of an exemplary embodiment of the present invention, taken along line 4-4 of FIG. 2.
Figure 5:
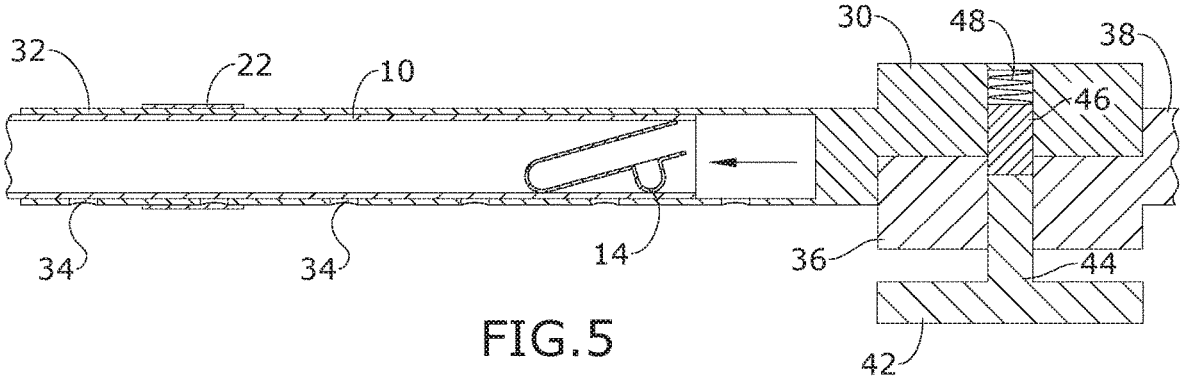
FIG. 5 is a section view of an exemplary embodiment of the present invention, illustrating the depressing on snap button 14 to secure the adjusted length of frame elements 10.
Figure 6:
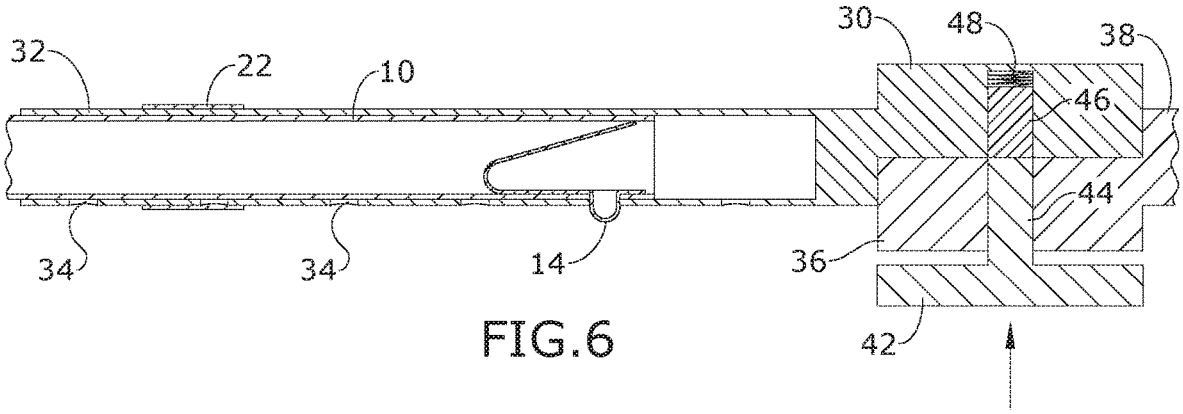
FIG. 6 is a section view of an exemplary embodiment of the present invention, illustrating depressing of locking button 42 to an unlocked engagement, allowing for rotation of the inner and outer discs 30 and 36 relative to each other.
Figure 7:
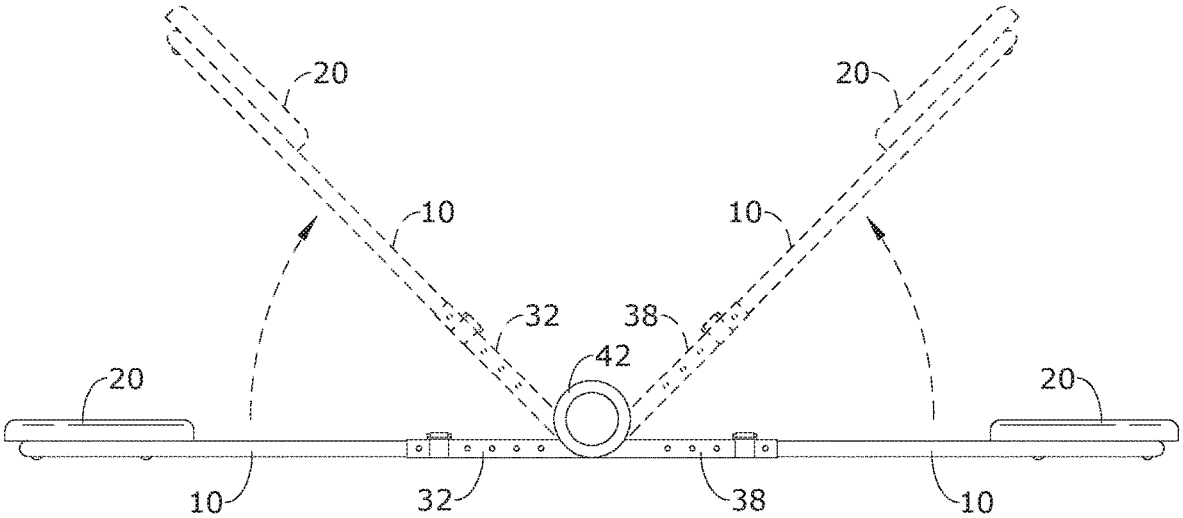
FIG. 7 is a front view of an exemplary embodiment of the present invention, illustrating the rotation (when locking button 42 is depressed) from a flat, operable condition to a folded, storage condition.
Figure 8:
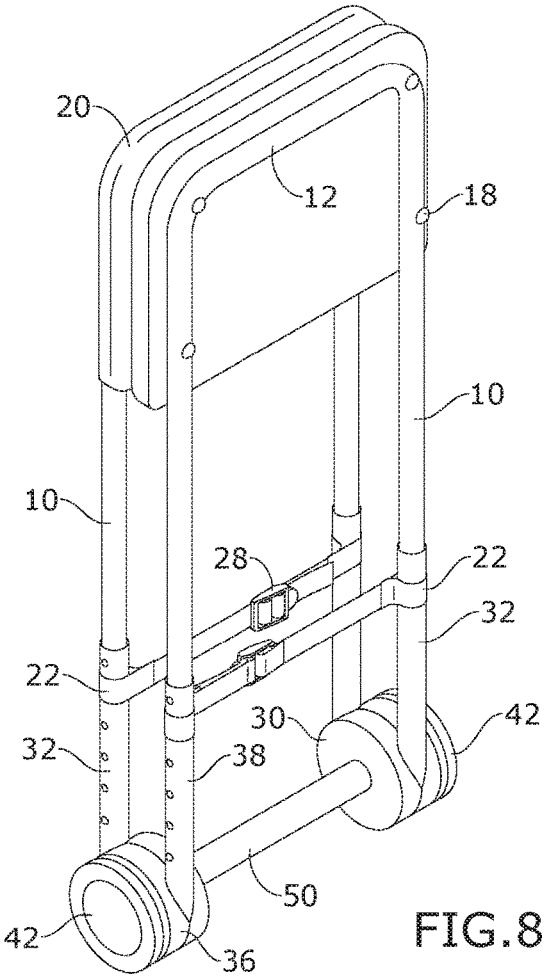
FIG. 8 is a perspective view of an exemplary embodiment of the present invention in the storage condition.

Referring to FIGS. 1 through 8, the present invention may include a tandem sit-up device 100. The tandem sit-up device 100 may include two support frameworks interconnected by a pivot bar 50 so that the two support frameworks are movable relative each other between a flat, operable condition and a folded, storage condition, as illustrated in FIGS. 7 and 8.

Each support framework provides two spaced apart frame elements 10, each frame element 10 may be an elongated member made of aluminum or other material sufficiently strong to withstand the repeated bending and stress contemplated herein. Typically, but not necessarily, the frame elements 10 are cylindrical tubes. Each frame element 10 extends between a distal end and a proximal end operatively associating with the pivot bar 50. The distal ends of each support framework's two frame elements 10 may support a seat portion 20 dimensioned and adapted to accommodate a seated human user 52 or 54. The seat portion 20 may be attached to the distal end by way of frame holes 16 and fasteners 18. The distal ends of each support framework may be joined by a crossbar 12. In certain embodiments, the crossbar 12 gives the support framework a U-shape, especially when the crossbar 12 joins to said distal ends with a rounded or curved joint or transition.

Adjacent to the proximal ends of each support framework, a foot strap 24 may extend between the spaced apart frame elements 10 at which the foot strap 24 is anchored thereto with by way of a connector 22. Each foot strap 24 may provide an adjustment mechanism 28, including but not limited to a buckle 28, for taking out the slack 26 from the foot strap 24 so that the foot strap 24 may be taught as it extends between the spaced apart frame elements 10. As a result, the users 52 and 54 may engage the foot strap 24 with their feet when doing a sit-up while seated on the seat portion 20.

In certain embodiments, the pivot bar 50 may provide an inner disc 30 associated with an outer disc 36 on each end of the pivot bar 50, wherein the inner disc 30 and the outer disc 36 are adapted to rotate relative to each other. The associated inner disc 30 and outer disc 36 may be placed in a locked engagement relative to each through a shared pin cavity in receipt of a locking pin 46 and a spring 48, as illustrated in FIG. 5. In the locked engagement, the locking pin 46 occupies the pin cavity formed by both discs 30 and 36, respectively, which is the biased state as a result of the spring 48 a distal portion of the pin cavity (in certain embodiments, in the inner disc 30). The locking pin 46 may be urged to an unlocked engagement, so as to occupy only the pin cavity of the inner disc 30, wherein the inner disc 30 can move relative to the outer disc 36. An unlocking button 42 is provided along a periphery of the outer disc 36. The unlocking button 42 has a button leg 44 dimensioned and adapted to be received in the pin cavity of the outer disc 36 so that when the unlocking button is depressed, as illustrated in FIG. 6, the biased state of the spring 48 is overcome, urging the locking pin 46 to occupy only the pin cavity associated with the inner disc 30.

It should be understood that directional terms, such as inner or outer, are best understood in reference to the figures, wherein the inner direction is directed toward a center of the pivot bar 50 and the outer direction is directed in the opposite direction as inner.

Each inner and outer disc 30 and 36 may provide a radially extending inner arm 32 and outer arm 38. Such arms provide a plurality of adjustment holes 34 and 40, respectively, so that a snap button 14 at the proximal end of the frame elements 10 can be selectively engaged in one of the plurality of adjustment holes 34 and 40, thereby adjusting a legroom distance from the seat portion 20 and the pivot bar 50 and/or the adjacent foot strap 24, as the foot strap 24 may be connected to the inner arm 32 and outer arm 38. By telescopically adjusting the engagement of the frame elements 10 and the arms 32 and 38, the users 52 and 54 can selectively tailor the legroom distance to their build, physical shape and/or leg length.

In certain embodiments, the distal ends of the frame elements 10 may be connected directly to the inner and outer discs 30 and 36, and the foot strap 24 may be adjusted to selectively define said legroom distance to the seat portion 20.

A method of using the present invention may include the following. The tandem sit-up device 100 disclosed above would be provided. After defining said legroom distances, the two users 52 and 54 would sit on the opposing seat portions 20 and do sit-ups simultaneously.

It should be understood, of course, that the foregoing relates to exemplary embodiments of the invention and that modifications may be made without departing from the spirit and scope of the invention as set forth in the following claims.

What is claimed is:

1. A tandem sit-up device, comprising:

two support frameworks interconnected by a pivot assembly so that the two support frameworks move between an operable condition and a folded storage condition;

each support framework extends between a distal end and a proximal end operatively associating with the pivot assembly; the pivot assembly comprising: a pivot bar; an inner disc rotatably connected to an outer disc on each end of the pivot bar; and the proximal end operatively associated with each inner disc and each outer disc;

a seat portion connected to each distal end; and a foot strap provided adjacent to each proximal end, whereby a human user seated on the seat portion engages their feet with the foot strap adjacent thereto to do a sit-up.

2. The tandem sit-up device of claim 1, further comprising:

the pivot assembly further comprising:

an arm radially extending from each inner and outer disc.

3. The tandem sit-up device of claim 2, wherein each support framework comprises two spaced apart frame elements;

each arm telescopically engages one of the two spaced apart frame elements; and a snap button provided by at least one of the two spaced apart frame elements for selectively engaging one of a plurality of adjustment holes provided along a length of at least two of the arms.

4. The tandem sit-up device of claim 3, further comprising:

an inner pin cavity provided by each inner disc;

an outer pin cavity provided by each outer disc;

a spring in each inner cavity;

a locking pin that engages the spring and extends into the outer pin cavity in a locked engagement between the outer and inner discs; and an unlocking button operatively associated with each locking pin for urging the locking pin against the spring and out of the outer pin cavity in an unlocked engagement, enabling the outer and inner discs to rotate relative to each other.

5. The tandem sit-up device of claim 1, further comprising:

an inner pin cavity provided by each inner disc;

an outer pin cavity provided by each outer disc;

a spring in each inner cavity;

a locking pin that engages the spring and extends into the outer pin cavity in a locked engagement between the outer and inner discs; and an unlocking button operatively associated with each locking pin for urging the locking pin against the spring and out of the outer pin cavity in an unlocked engagement, enabling the outer and inner discs to rotate relative to each other.

* * * * *